US006893205B2

(12) United States Patent
Heim et al.

(10) Patent No.: US 6,893,205 B2
(45) Date of Patent: May 17, 2005

(54) VEHICLE TRANSPORTATION MODULE

(75) Inventors: Ralph W. Heim, Jacksonville, FL (US); J. Edward Morley, Jacksonville, FL (US); Prakash W. Shahani, Clinton, NJ (US)

(73) Assignee: Trailer Bridge, Inc., Jacksonville, FL (US)

( * ) Notice: Subject to any disclaimer, the term of this patent is extended or adjusted under 35 U.S.C. 154(b) by 0 days.

(21) Appl. No.: 09/885,663

(22) Filed: Jun. 20, 2001

(65) Prior Publication Data

US 2002/0009344 A1 Jan. 24, 2002

Related U.S. Application Data

(63) Continuation-in-part of application No. 09/364,910, filed on Jul. 28, 1999, now Pat. No. 6,416,264.
(60) Provisional application No. 60/094,601, filed on Jul. 30, 1998.

(51) Int. Cl.[7] ..... B60P 7/00
(52) U.S. Cl. ..... 414/812; 410/4; 410/24; 410/26
(58) Field of Search ..... 410/4, 24, 26; 414/809, 812, 810, 332, 498, 537, 475, 476, 480, 482, 484

(56) References Cited

U.S. PATENT DOCUMENTS 2,521,088 A * 9/1950 Phelps
3,934,740 A * 1/1976 Rumell
4,343,401 A * 8/1982 Paulyson ..... 410/26 X
4,759,668 A * 7/1988 Larsen et al. ..... 410/26
4,801,229 A * 1/1989 Hanada et al. ..... 410/26
4,875,821 A * 10/1989 Oren ..... 410/4 X
4,911,590 A * 3/1990 Green ..... 410/26
4,963,067 A * 10/1990 Gearin et al.
5,037,255 A * 8/1991 Bullock et al. ..... 410/30
5,051,046 A * 9/1991 Oren ..... 410/29.1
5,106,246 A * 4/1992 Chance ..... 410/26
5,110,242 A * 5/1992 Chance ..... 410/26
5,213,458 A * 5/1993 Preller et al. ..... 410/26
5,286,149 A * 2/1994 Seay et al. ..... 410/26
5,344,266 A * 9/1994 Kolb ..... 410/26
5,427,485 A * 6/1995 Henderson et al. ..... 410/26
5,526,940 A * 6/1996 Shea et al.
5,730,578 A * 3/1998 Smidler
5,775,858 A * 7/1998 Bacon ..... 410/26
5,853,280 A * 12/1998 Lohr ..... 410/24 X
6,010,285 A * 1/2000 Cox et al. ..... 410/26
6,416,264 B2 * 7/2002 Heim et al. ..... 410/4
6,503,034 B2 * 1/2003 Heim et al. ..... 410/4

* cited by examiner

*Primary Examiner*—Stephen Gordon
(74) *Attorney, Agent, or Firm*—Thompson Hine LLP

(57) ABSTRACT

A method for transporting vehicles including the steps of providing a module shaped and sized to receive vehicles therein and providing a trailer chassis coupled to a tractor. The tractor and the trailer chassis are located on or adjacent to an external surface. The method further includes the step of locating the module on a trailer chassis, and driving the vehicles from the external surface into the module.

25 Claims, 7 Drawing Sheets

VEHICLE TRANSPORTATION MODULE

This application is a continuation-in-part of Ser. No. 09/364,910, filed Jul. 28, 1999, now U.S. Pat. No. 6,416, 264, which claims priority to U.S. Serial No. 60/094,60 1 filed Jul. 30, 1998. The contents of these documents are hereby incorporated by reference.

BACKGROUND OF THE INVENTION

The present invention is directed to methods for shipping vehicles, and more particularly, to a method for shipping vehicles by modules. The present invention is also directed to a tractor/trailer chassis combination, and a method for manipulating a tractor/trailer chassis combination.

Standard-sized freight containers are often used when transporting motorized vehicles, such as cars, trucks, sport utility vehicles and the like. Once the vehicles are mounted in the freight containers, the containers can be loaded on trains, barges, truck chassis and other transportation systems. When vehicles are transported inside a container, it is, of course, desired to minimize damage imparted to the vehicles by the container. The standard-sized freight containers used to transport vehicles are relatively narrow, typically having a width of about 8 feet. Thus, when a vehicle is placed into such a container, typically by driving them into the container, it may be difficult for a driver to open the vehicle door and exit the vehicle and container without damaging the vehicle. The lack of clearance between vehicle and container increases the chances of damaging vehicles during vehicle loading and unloading operations. It is also difficult for a worker to access a vehicle stored in such a container in order to secure the vehicle in the container, or to walk by the vehicle without contacting the vehicle.

Space is at a premium in transportation systems, and since standard freight containers are not optimally sized to receive vehicles such containers include much wasted space when transporting vehicles. For example, standard freight containers typically have a height of either 8'6", or 9'6", and most vehicles typically have a height of between about 4'11" and about 6'6", which means that there is usually a large amount of unutilized space located over the roofs of the vehicles after they are loaded into a standard container. The containers are often stacked on top of each other, which compounds the wasted vertical space.

To address this problem, systems have been developed which stack or otherwise arrange two layers of vehicles within a single freight container. These containers can be either generally open containers that lack side walls or closed containers having side walls. However, stacking two layers of vehicles requires additional machinery, power and time, all of which contribute to increased shipping costs. The vehicles can also be easily damaged during the stacking and/or arranging operations, and the open containers often do not provide adequate protection from the elements. Furthermore, it can be difficult to load and unload vehicles into standard freight containers.

When shipping vehicles via tractor/trailers, in most cases the container must first be filled with vehicles, and then loaded onto the tractor/trailer, such as by a reach stacker. Once the tractor/trailer is driven to the destination location, the container is usually lifted off the tractor/trailer, and the vehicles are then unloaded. However, this can be a relatively inefficient method for loading and unloading vehicles into the module.

Accordingly, there is a need for a method for quickly and easily transporting vehicles.

SUMMARY OF THE INVENTION

The present invention is a system for transporting vehicles that provides for quick and efficient transportation of vehicles. For example, the method of the present invention enables vehicles to be directly driven onto a module that is located on a trailer. The module can then be transported by a tractor/trailer combination to a destination location, at which time the vehicle can be unloaded from the module (such as by driving the vehicles down a ramp), or by transferring and further transporting the entire, loaded module.

In one embodiment, the invention is a method for transporting vehicles comprising the steps of providing a module shaped and sized to receive vehicles therein, locating the module on a trailer and driving the vehicles from an external surface into the module. The module may be pivoted during loading and unloading operations. In another embodiment, the invention is a method for transporting at least one vehicle comprising the steps of providing a module shaped to receive at least one vehicle therein, providing a trailer, and locating the module on the trailer. The method further includes the steps of coupling the module to the trailer, driving at least one vehicle from an external surface into the module, and transporting the trailer to a desired location. The module may be pivoted during loading and unloading operations.

The invention further includes a tractor/trailer chassis combination including a tractor and a trailer chassis coupled to the tractor. The trailer chassis includes a frame and least one set of wheel that is movable along at least part of the length of said trailer. The combination further includes lifting means coupled to the tractor for pivoting the trailer chassis.

Other objects and advantages of the present invention will be apparent from the following description, the accompanying drawings and the appended claims.

DETAILED DESCRIPTION

Figure 1:
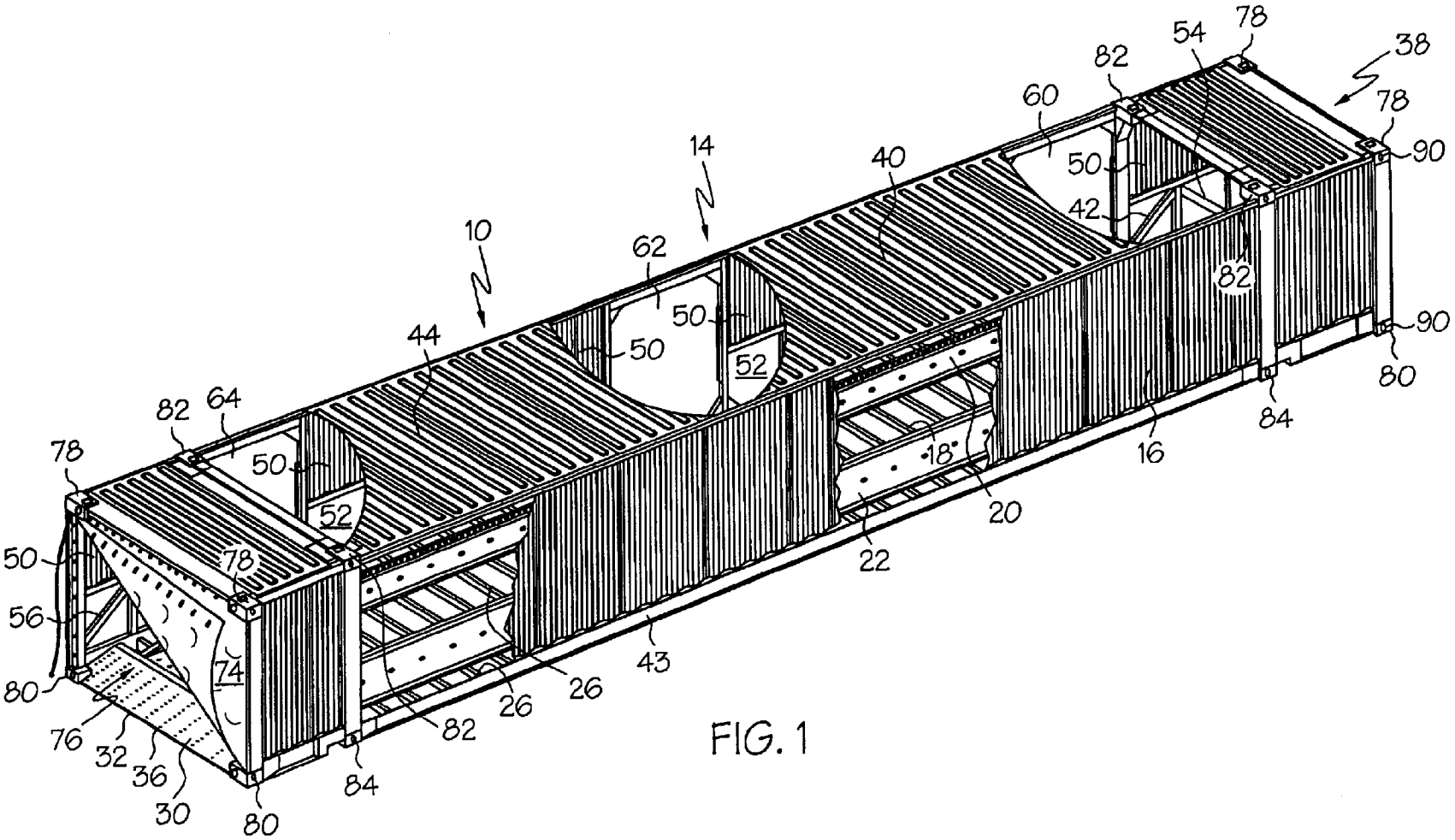
FIG. 1 is a top perspective view of a one embodiment of the module of the present invention, with parts of the passenger-side side wall and roof cut away.
Figure 3:
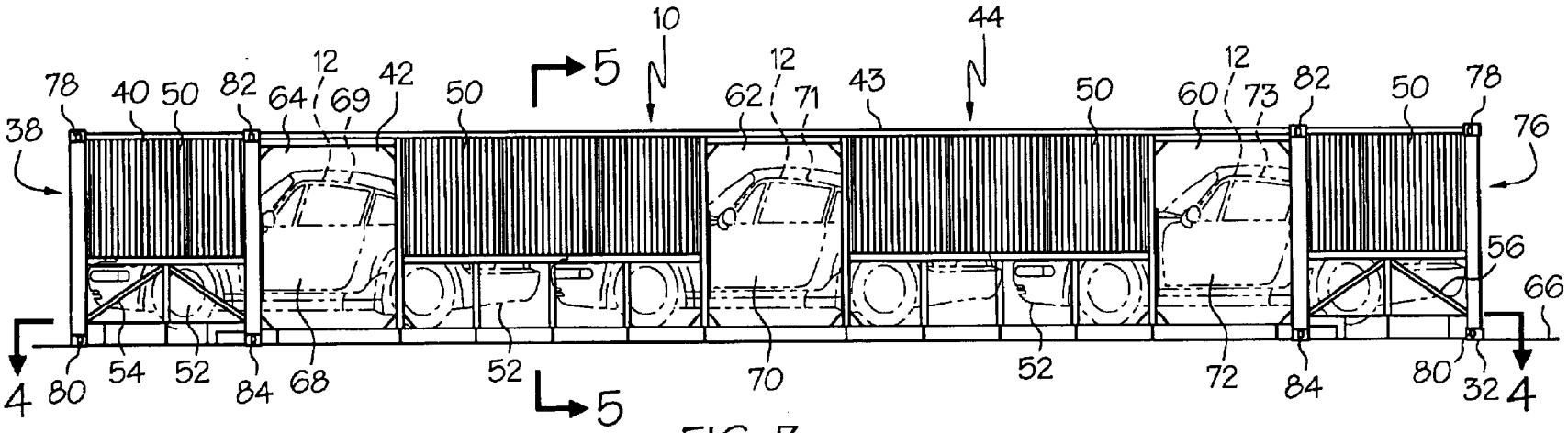
FIG. 3 is a left side view of the module of FIG. 1, shown with three vehicles loaded therein.

As shown in FIG. 1, the present invention is a module 10 for receiving and transporting motorized vehicles 12 (FIG. 3). The module 10 is generally rectangular in cross-section, and includes a driver-side side wall 14 and a passenger-side side wall 16 that extends parallel to, and is laterally spaced apart from, the driver-side side wall 14. For the purposes of this application, the steering wheel and the driver of the vehicles 12 have been assumed to be on the left hand side of each vehicle 12. However, the module 10 of the present invention can be easily modified to accommodate vehicles where the steering wheel is located on the right hand side of the vehicle (or the vehicles are backed into the module) by changing the orientation of several components of the module 10 in a manner that would be readily apparent to one skilled in the art.

Figure 4:
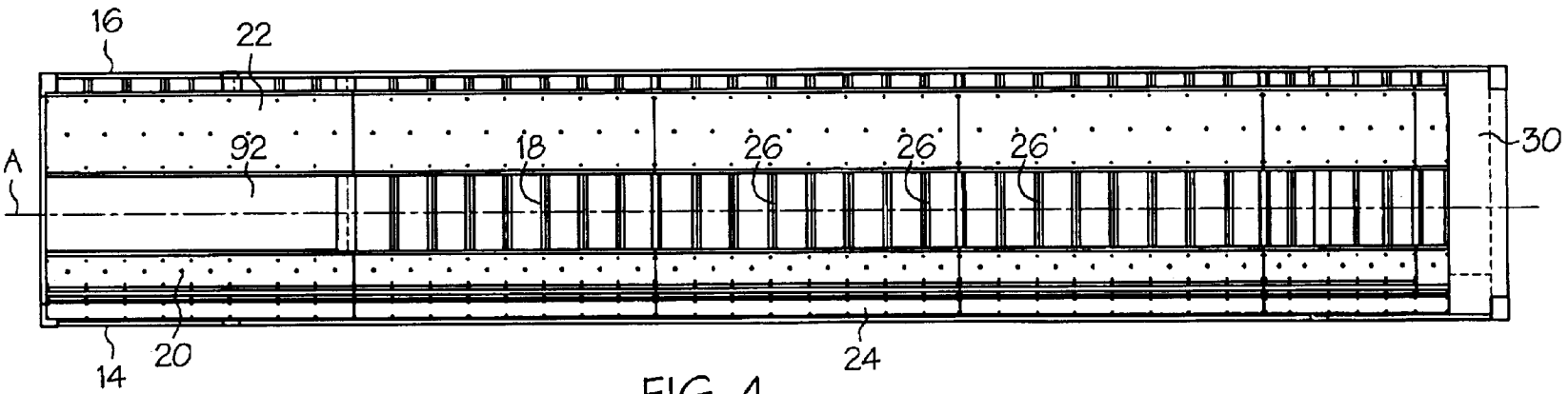
FIG. 4 is a section taken at line 4—4 of FIG. 3.
Figure 5:
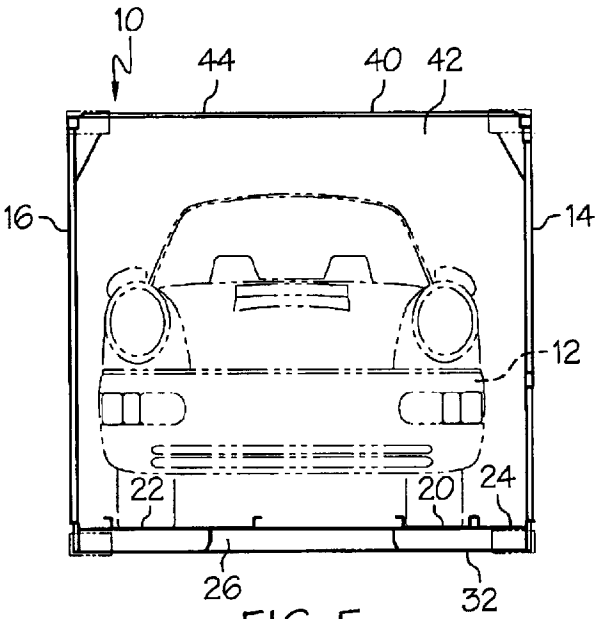
FIG. 5 is a section taken at line 5—5 of FIG. 3.
Figure 6:
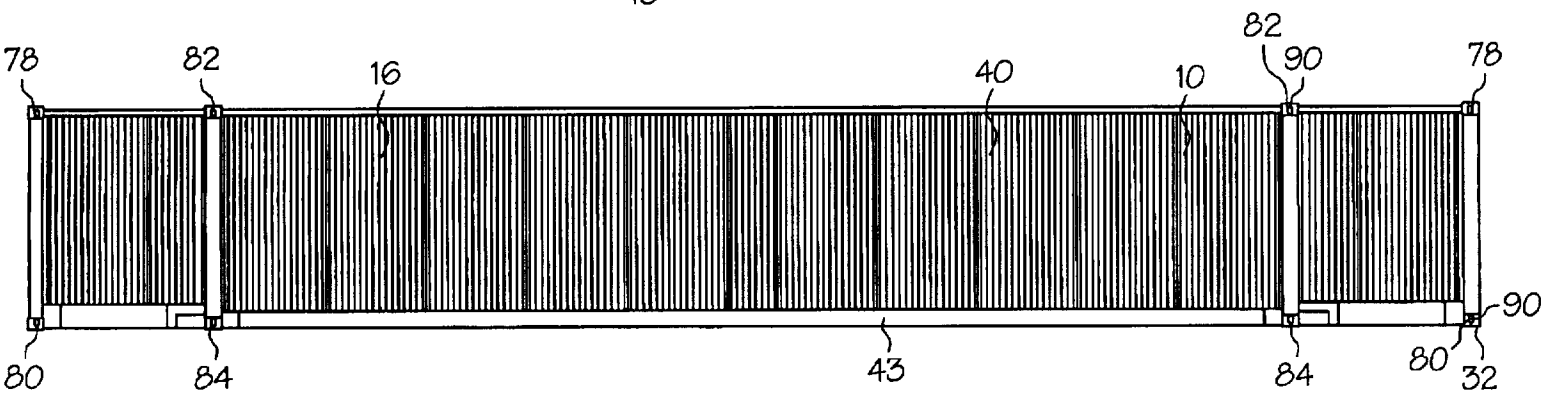
FIG. 6 is a right side view of the module of FIG. 1.

A bottom support structure, generally designated 18, extends between the side walls 14, 16 and supports the vehicles 12 that are received in the module 10. As best shown in FIG. 4, the bottom support structure 18 includes a pair of longitudinally extending wheel pans 20, 22 for receiving the wheels of a vehicle 12. A walkway 24 extends parallel to the wheel pans 20, 22, and is located adjacent the driver-side side wall 14 to provide a surface for a worker to walk upon when the module 10 is empty. A plurality of laterally extending crossbeams 26 support the wheel pans 20, 22 and the walkway 24.

The module 10 includes an angled ramp or inclined surface 30 that extends from the bottom 32 of the module 10 to the bottom support structure 18 such that vehicles 12 can be driven up the ramp 30 and into the wheel pans 20, 22 of the bottom support structure 18. The ramp 30 preferably extends from the driver-side side wall 14 to the passenger-side side wall 16. The ramp 30 is preferably integral with the module 10 and is completely internal to the module 10; that is, the ramp 30 does not extend in the longitudinal direction beyond the side walls 14, 16. Because the ramp 30 does not extend beyond the side walls 14, 16, space in the module 10 in the longitudinal direction is conserved. The lip 36 at the bottom of the ramp 30 (FIG. 1) is relatively small (i.e. preferably about 1½" high) so that a vehicle 12 can be easily driven over the lip 36. The module 10 also includes an end wall 38 that encloses the forward end of the module 10.

The module 10 includes an enclosure 40 having a generally rectangular cross section and a central space 42 for receiving the vehicles 12. A roof 44 extends between the side walls 14, 16 and parallel to the bottom support structure 18. The roof 44 and bottom support structure 18 are spaced apart a distance to closely receive a vehicle 12 therebetween to minimize the wasted vertical space in the module 10. Similarly, the side walls 14, 16 are spaced apart a distance to minimize the wasted space in a lateral direction, while still providing sufficient space between the side walls 14, 16 to accommodate the walkway 24.

The wheel pans 20, 22 are offset from a longitudinally extending center line A of the module 10 (FIG. 4) toward the passenger-side side wall 16. This offset helps to minimizes the wasted space in the lateral direction by ensuring that the passenger side of the loaded vehicles 12 are located as close as practicable to the passenger-side side wall 22. As shown in FIG. 4, the driver-side wheel pan 20 is relatively narrow compared to the passenger-side wheel pan 22. The relatively narrow width of the driver-side wheel pan 20 serves to locate the vehicle 12 in the desired lateral position within the module 10, and the extra width of the passenger-side wheel pan 22 accommodates vehicles 12 of varying widths. In this manner, a driver can guide the driver-side wheel of each vehicle 12 into the driver-side wheel pan 20, and the driver does not have to worry about locating the passenger-side wheels 22. Finally, the module 10 has a length that is selected to closely receive a predetermined number of vehicles 12 to minimize wasted space in the longitudinal direction. In the illustrated embodiment, the module 10 is sized to receive three vehicles 12 in a single layer.

The height of the module 10 is preferably selected such that the vertically unutilized space is minimized. Preferably, the distance between the roof of a vehicle received in the module and the roof 44 of the module is less than 1 foot. This distance has been found to provide adequate clearance such that the vehicles do not contact the roof 44 when the vehicles are driven into the module 10, or when bumps or jolts are applied to the module 10 during transportation of the module. The 1 foot distance is also small enough to minimize wasted space in the vertical direction. If the height of the module is less than 8 feet, the desired clearance can be provided for most vehicles. Further alternately, the space between the roof of the vehicle and the roof of the module is less than about ⅓ of the height of the vehicle. Further alternately, the distance between the roof of the vehicle and the roof 44 of the module is less than about ⅕ of the height of the module.

The sides walls 14, 16, end wall 38 and roof 44 are preferably all made from corrugated metal or other materials suitable to provide the necessary structural strength and protection. The module 10 includes a skeletal framework 43 of square tubular sections at the top of the module 10 and formed channels at the bottom of the module. The driver-side side wall 14 preferably includes a plurality of openings that correspond to the driver-side door of each vehicle received in the module 10. Thus, in the illustrated embodiment, the driver-side side wall 14 includes three openings 60, 62, 64. In the illustrated embodiment, the driver-side side wall 14 includes a plurality of corrugated side panels 50 that extend approximately half the distance from the roof 44 to the bottom support structure 18. The bottom openings 52 underneath the side panels 50 provide access to the inner volume of the module 10 to enable workers to place and remove wheel chocks (not shown) in the wheel pans 20, 22 to secure the vehicles 12 in place from outside the module 10. The driver-side side wall 14 includes a forward truss 54 and a rearward truss 56 to provide support. However, the panels 50 may alternately extend the full distance from the roof 44 to the bottom support structure 18, in which case the wheel chocks can be located by a worker who is inside the module 10.

As noted earlier, the module 10 is preferably sized to closely receive a plurality of vehicles therein. In one embodiment, the module 10 is sized to receive three vehicles and is about 53' long. In this embodiment, each of the side openings 60, 62, 64 is approximately 5' in width and approximately 6'4" in height. The opening 60 is spaced approximately 9'10" on center from the end wall 38 of the module 10, the opening 62 is located approximately at the center of the module 10 along its length, and the opening 64 is spaced about 9'10" on center from the rear end of the module 10. Preferably, the module 10 is one of two different heights: 6' high for vehicles 59" and below in height and 7'6" for vehicles from 59" to 78.5" in height. The module 10 is preferably about 8' to about 8'6" in width (i.e. the external dimension of the module 10 in the lateral direction).

The module 10 of the present invention may be loaded with vehicles 12 as follows.

The module 10 is placed flat onto an external surface 66 (FIG. 3), such as a loading dock, driveway, vessel deck, or the like. When placed on the external surface 66, the angled ramp 30 extends from the external surface 66 to the bottom support surface 18 of the module 10 such that vehicles 12 can be driven up the ramp 30 and into the wheel pans 20, 22 of the bottom support structure 18. Because the vehicles 12 may be driven into the module, the vehicles can be quickly and easily loaded into the module 10 without the aid of an external ramp.

A first vehicle 69 is driven up the ramp 30 and onto the wheel pans 20, 22, and the first vehicle 69 is then driven through the length of the module 10 until the front driver-side door 68 of the first vehicle 69 coincides with the opening 64. The driver then opens the door 68 into the opening 64, exits the first vehicle 69, and closes the door 68. The driver then may exit the module through the opening 64. Thus, besides providing a space through which the front driver-side door 68 is received, the opening 64 provides an exit path from the module 10 for the driver. When the driver exits through the opening 64, this helps to minimize any further damage that may be imparted to the vehicle when the driver walks alongside the first vehicle 69. For example, keys, tools, or other items that the driver may carry, or a belt buckle or other metallic clothing items on the driver may damage the vehicle as the driver walks alongside the first vehicle 69. Thus, by minimizing the distance the driver must walk alongside the vehicles 12, the chances of damaging the vehicles 12 in such a manner are correspondingly minimized. When unloading the vehicles 12, the openings 60, 62, 64 also provide a point of entry into the module 10 to minimize driver-induced damage.

The driver or another worker then places wheel chocks (not shown) in front of the front driver-side wheel, and behind the rear driver-side wheel of the first vehicle 69 to secure the first vehicle 69 in the module 10. The wheel chocks or other securements can be placed in position by reaching through the bottom openings 52. This enables a worker to place the wheel chocks from outside the module 10, which minimizes contact with the vehicles 12. After the first vehicle 69 is secured in the module 10, a second vehicle 71 is driven into the module 10 in a similar manner such that the front driver-side door 70 of the second vehicle 71 coincides with the opening 62. The driver then exits through the opening 62 and secures the second vehicle 71 with wheel chocks. Finally, a third vehicle 73 may be driven into the module 10 such that the driver-side door 72 of the third vehicle 73 coincides with the opening 60. The driver then preferably exits through the opening 60 and secures the third vehicle 73 in place.

Figure 7:
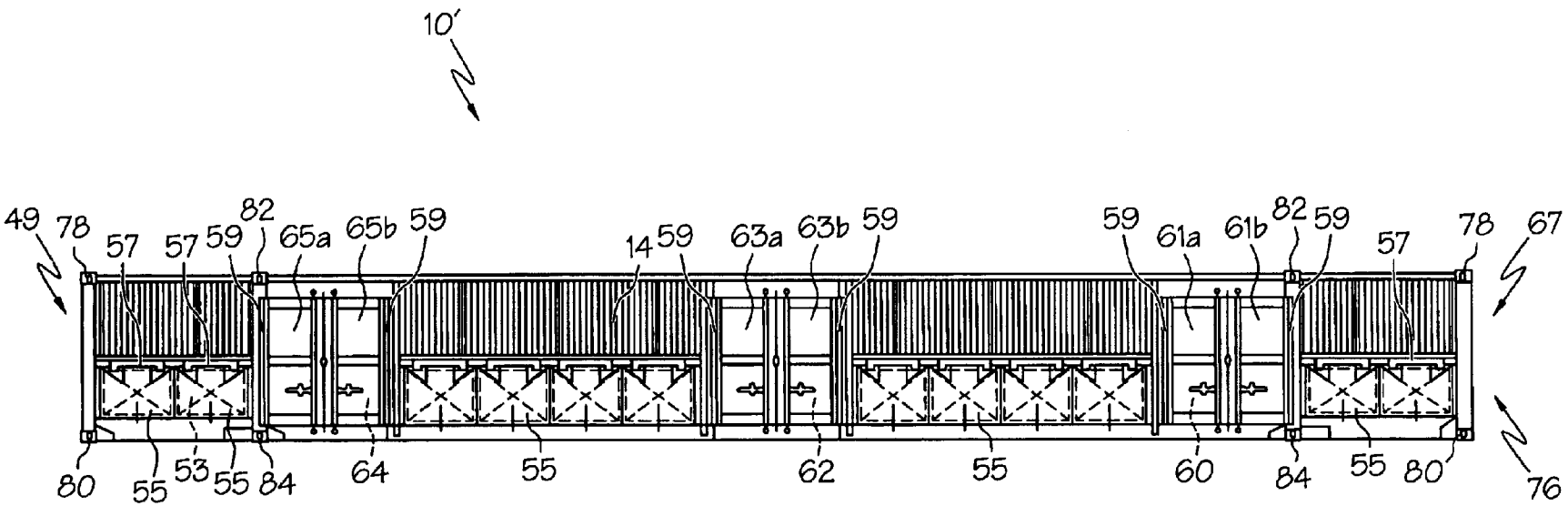
FIG. 7 is a side view of an alternate embodiment of the module of the present invention.

Once the module 10 is fully loaded, a tarp 74 (FIG. 1) may be located over the rear end opening 76 of the module 10 to protect the vehicles 12. The module 10 may then be loaded onto another carrier such as a barge, chassis, rail car, or other transportation system. As shown in FIG. 7, in an alternate embodiment the module 10' may include a plurality of lower doors 55, each door covering one of the lower openings 53. The lower doors 55 help to protect the vehicles inside the module 10' while enabling workers to access the internal space of the module 10' for the placement or removal of wheel chocks. Each lower door 55 is preferably pivotably mounted to the module 10' by a hinge 57 such that users can pivot each door 55 about its hinge 57 to place or remove wheel chocks from the internal space of the module 10'.

The module 10' may also include a set of doors 61*a*, 61*b*, 63*a*, 63*b*, 65*a* and 65*b* which can cover the openings 60, 62, 64, respectively, to protect the contents of the module 10'. Each of the doors 61*a*, 61*b*, 63*a*, 63*b*, 65*a* and 65*b* is preferably pivotable about a hinge line 59 to enable the doors to open and close. The module may also include a door 67 to cover the rear end opening 76 of the module in place of the tarp 74. In this manner, the side walls 14, 16 and doors 55, 61*a*, 61*b*, 63*a*, 63*b*, 65*a*, 65*b* and 67 provide a continuous outer surface defining an enclosed space to protect the vehicles located inside the module 10'. The doors 55, 61*a*, 61*b*, 63*a*, 63*b*, 65*a*, 65*b* and 67 can preferably each be locked shut to secure the module 10' and protect the contents of the module from theft, vandalism and the like. For example, each of the doors 61*a*, 63*a* and 65*a* may be securable to the corresponding door 61*b*, 63*b* and 65*b*.

The end wall 38 may be replaced with a pivotable front end door 49 located adjacent to the front end opening of the module 10, 10', similar to the door 67 discussed above. This front end door 49 enables the vehicles to be driven into or out of the front of the module 10, 10'. In this manner, the module 10, 10' can be loaded by driving vehicles forwardly entering into the module 10, 10', and can be unloaded by driving vehicles forwardly exiting from the module 10, 10'. For example, vehicles can be loaded into the module 10, 10' by driving the vehicles forwardly through the rear end opening 76, and then closing and securing the rear door 67. The module 10, 10' can then be transported, such as by Wain, and then placing the module onto a flat surface at the destination location. The module 10, 10' can then be unloaded, such as by opening the front end door 49, and driving the vehicles forwardly through the front end opening. The front 49 and rear 67 doors enables vehicles to be loaded and unloaded while being driven forwardly only, and may eliminate the need to back up vehicles into or out of the module. This enables quick and more efficient loading and unloading of vehicles. Of course, this feature can only be used where there is proper clearance or structure to enable the vehicles to exit the desired end of the module.

The module 10, 10' is preferably stackable so that a number of modules can be stacked both side-by-side and/or on top of one another (i.e. up to five or six modules high or more). Accordingly, each module 10, 10' preferably includes a set of upper corner castings 78 and a set of lower corner castings 80 for receiving twist locks (not shown) therein. The twist locks help to secure the vertically-stacked modules to each other at their corner castings. The lower corner castings 80 may also be used to secure the front end of the module 10 to a chassis by receiving lock pins therein.

The module 10, 10' further preferably includes a set of intermediate upper castings 82 and intermediate lower castings 84. The intermediate upper castings 82 are preferably longitudinally spaced about 40' apart such that the module 10, 10' can be lifted by a standard ISO ("International Standards Organization") spreader that fits into the intermediate upper castings 82. The intermediate upper castings 82 can also be used to lock the module 10, 10' (through the use of twists locks) to a standard container that is stacked on top of the module 10, 10'. The intermediate lower castings 84 are also preferably spaced apart about 40', and can be used to lock the module 10, 10' onto a standard 40' long container when the module 10, 10' is stacked onto a standard container (not shown). This feature is particularly useful when stacking the module 10, 10' onto a standard container in a double stack rail car. The standard container may be located in the well of the rail car, and the module 10, 10' stacked on top of the standard container and secured to the standard container by twist locks passed through the lower intermediate castings 84 and the corner castings of the standard container.

Each of the castings 78, 80, 82, 84 preferably includes side apertures 90 such that lashings can be passed through the side apertures 90 to secure the module 10, 10'. The side apertures 90 also provide a surface for receiving the hook of a loading machine to load or move the module 10, 10'. One embodiment of the twist locks that can be used with the corner castings 78, 80, 82, 84 are model C5AM-DF double cone semi-automatic twist locks manufactured by Buffers USA of Jacksonville, Fla. One embodiment of the corner casting 78, 80, 82, 84 may also be obtained from Buffers USA and are ISO type corner castings that are modified for the extra width of the module 10, 10'.

Figure 2:
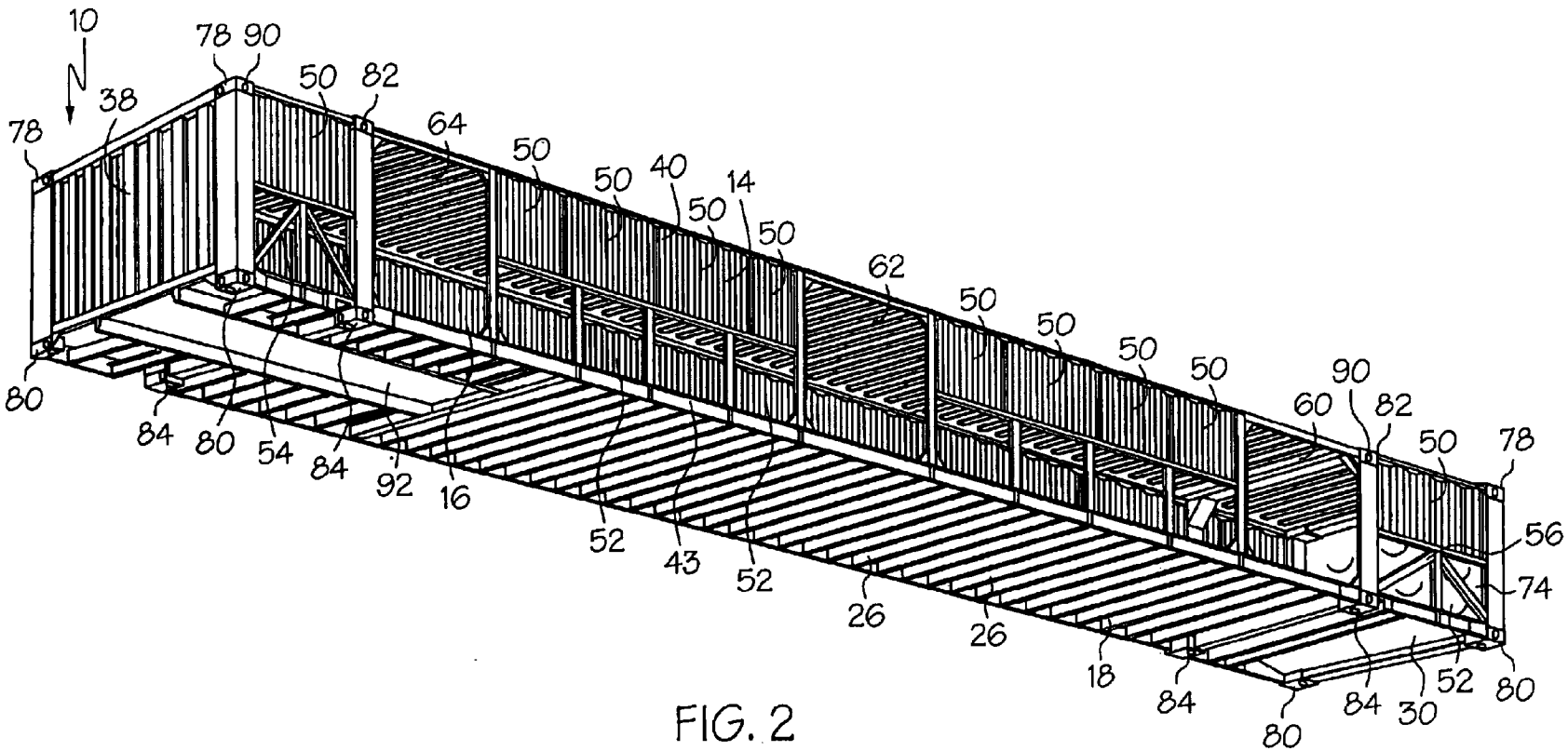
FIG. 2 is a bottom perspective view of the module of FIG. 1.

The module 10, 10' includes a standard-sized cutout, or tunnel 92, in its bottom support structure 18, as best shown in FIG. 2. When the module 10, 10' is loaded onto a chassis, the tunnel 92 is shaped to receive the gooseneck of the chassis to help lock the module 10, 10' into position on the chassis.

When stacking two or more modules side-by-side, and at least one of the modules 10 lacks the doors 55, 61*a*, 61*b*, 63*a*, 63*b*, 65*a* and 65*b*, the outermost modules of the stack are preferably arranged such that the passenger-side side wall 16 of each module faces outward and the openings 60, 62, 64 of each module face inwardly. Because the passenger-side side wall 16 lacks the openings 60, 62, 64, the wall 16 provides greater protection from the elements, such as sea spray or rain. For example, if two modules are to be stacked side-by-side, they are preferably arranged such that the openings 60, 62, 64 face each other and the passenger-side side walls 16 are located around the outer perimeter of the two modules. If multiple modules are stacked side-by-side, they are preferably arranged such that the driverside side walls 14 of the end modules face inwardly. Alternately, a standard container may be located adjacent the driver-side side wall 16 of a module to cover the opening 60, 62, 64 and protect the vehicles in the module 10. Further alternately, a tarp may be used to cover the opening 60, 62, 64 if the module lacks doors covering the openings.

Figure 8:
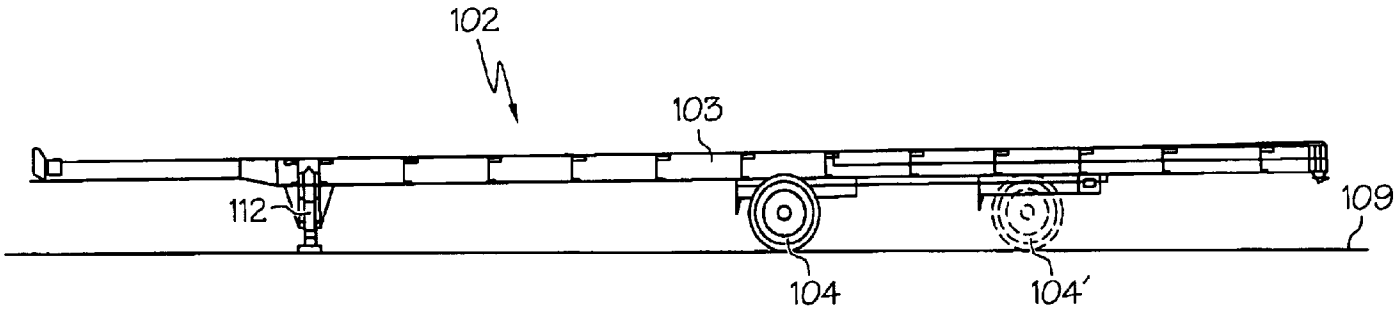
FIG. 8 is a side view of a trailer that may be used with a module of the present invention.
Figure 9:
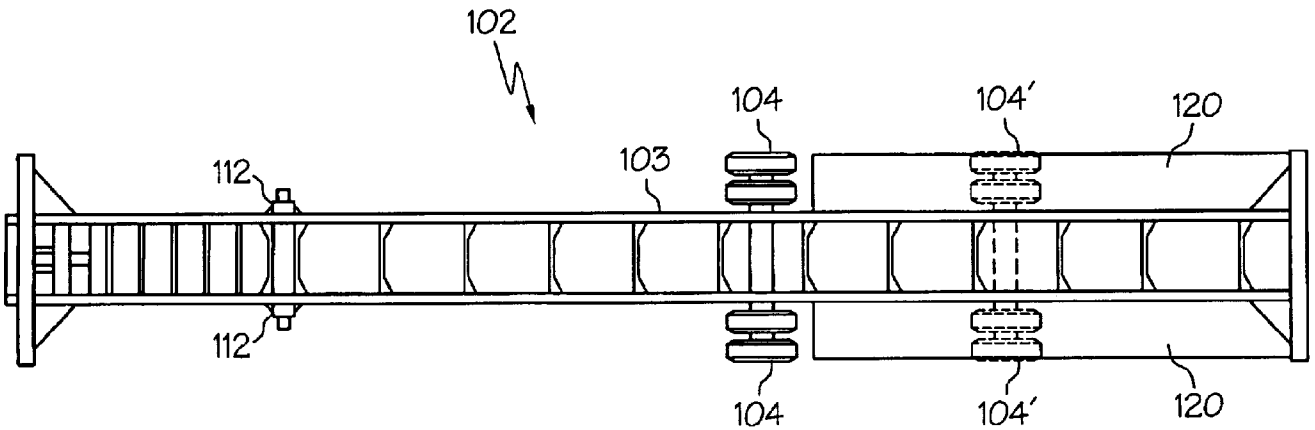
FIG. 9 is a top view of the trailer of FIG. 8.

As noted earlier, the module 10, 10' may be located on a ground surface during loading. However, in an alternate embodiment of the invention, the module may be removably located on a trailer or trailer chassis such that the modules can be loaded while the module is located on the trailer. For example, FIGS. 8 and 9 illustrate a trailer chassis 102 having a frame or bed 103, a running gear or set of wheels 104, and a support jack or landing gear 112. The trailer chassis 102 includes a slide frame or suspension system (not shown) that couples the wheels 104 to the frame. The suspension system enables the wheels 104 to move relative to the frame 103 between a pivot position (shown in solid lines in FIGS. 8 and 9) and an operating position (shown in hidden lines in FIGS. 8 and 9 as wheels 104').

Figure 10:
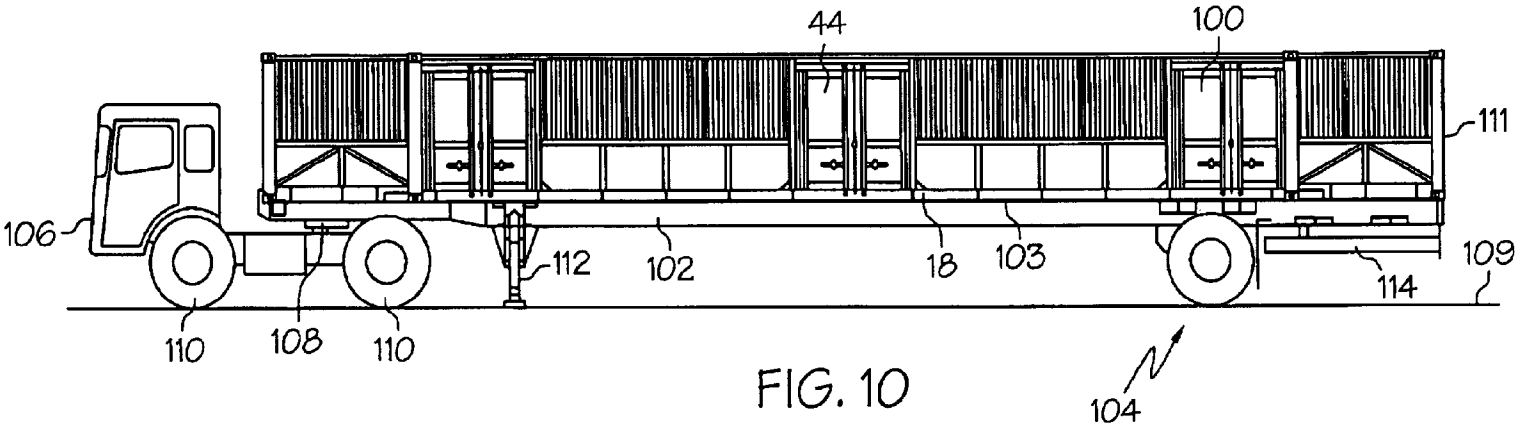
FIG. 10 is a side view of an one embodiment of the module of the present invention mounted onto a trailer in it rest condition.
Figure 11:
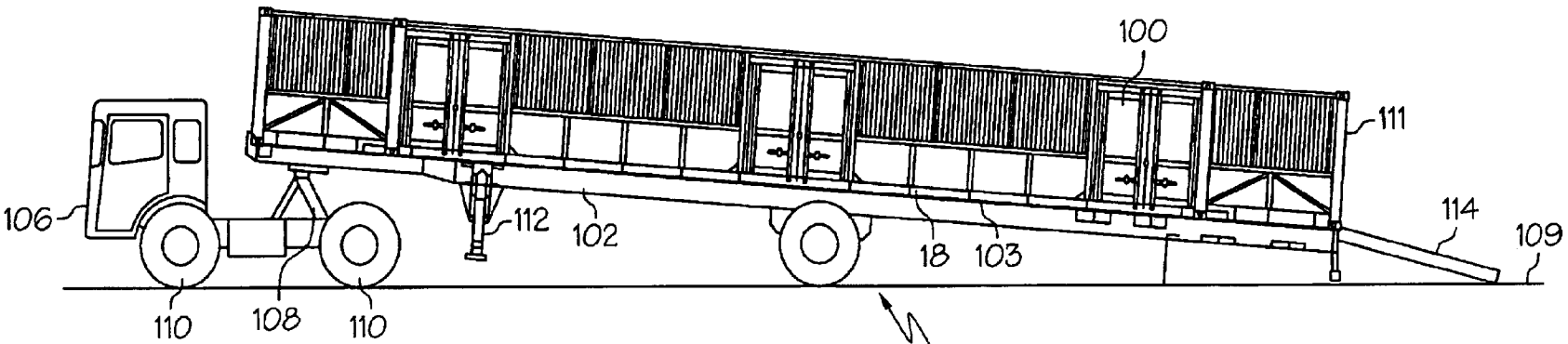
FIG. 11 is a side view of the module of FIG. 10 with the trailer shown in its loading condition.

The wheels 104 can be moved from the operating position to the pivot position in a wide variety of manners, and typically by coupling the trailer chassis 102 to a tractor 106 (see FIGS. 10 and 11). The wheels 104 of the trailer chassis may be coupled to the frame 103 by a suspension system that is movable along the length of the frame 103. Such suspension systems are well known in the industry, such as trailer air suspension system model No. RLU-228-6-3 sold by Holland Neway International, Inc. (a Member of the Holland Group, Inc.) of Muskegon, Mich. A trailer chassis having such a movable suspension system (i.e. a slider assembly) is typically slidably mounted to the trailer chassis, and the slider assembly can be locked in place relative to the trailer chassis 102 by a set of pins coupled to the slider assembly and received through a set of openings in the trailer chassis. In order to uncouple the suspension system from the trailer chassis, the pins are retracted or removed, which enables the suspension system to slide along the length of the trailer chassis 102. The brakes on the wheels 104 can then be locked, and the tractor 106 can be moved forwardly or rearwardly.

For example, when the pins of the slider assembly are retracted and the brakes on the wheels 104 are locked and the tractor 106 is moved rearwardly, the wheels 104 can be shifted in position from their operating position in FIG. 10 to their pivot position in FIG. 11 Such a "wheel shift" or "axle shift" maneuver is well known in the art. The wheels 104 can similarly be moved from the pivot position to the operating position by locking the brakes on the wheel 104 and moving the tractor 106 forward. When the wheels 104 and suspension system are located in the desired position, the pins are then replaced through a new, corresponding set of holes in the trailer chassis 102 in a manner well known in the art.

FIGS. 10 and 11 illustrate a module 100 located on the trailer chassis 102 with the trailer chassis 102 is in turn coupled to a tractor 106 in a manner well known in the art, such as by a fifth wheel or other coupling mechanism 108. The fifth wheel 108 is preferably a lifting or hydraulic fifth wheel, such as a lifting fifth wheel model M85 sold by the Bartlett Lifting Devices (a division of Kalmar Industries Corp of Ljungby, Sweden and Ottawa, Kans.), or a hydraulic fifth wheel as shown in U.S. Pat. No. 5,067,872, the contents of which are hereby incorporated by reference.

The module 100 can be removably coupled to the trailer chassis 102 by any of a variety of mechanisms, such as tie-downs, straps, bolts, bars, etc. in a manner well known in the art. The tractor 106 may be a motorized vehicle and include the fifth wheel 108 and a set of wheels 110. Alternately, the fifth wheel 108 may be coupled to the trailer chassis 102, or may be a separate, stand-alone component. In its condition in FIG. 10, the trailer chassis 102 is located in its transport position wherein the wheels 110 are located in their operating position and the trailer chassis 102 is generally level. In FIG. 10 the support jack 112 rests on the ground or external support surface 109 to help support the trailer chassis 102.

In order to load vehicles onto the module 100, the wheels 104 of the trailer chassis 102 may first be shifted to their pivot position, as described earlier. The hydraulic fifth wheel 108 is then activated to cause the trailer chassis 102 and module 100 to pivot about the wheels 104 of the trailer chassis 102, which causes the loading end 111 of the module 100 to be located closer to the ground, as shown in FIG. 11. In this manner the trailer chassis 102 can be pivoted between its transport position of FIG. 10 and its loading position of FIG. 11. Alternately, instead of using a hydraulic fifth wheel, nearly any other type of lifting mechanism may instead be used to raise or tilt the trailer chassis 102.

A ramp 114 can then be coupled to the rear end and bottom edge of the module 100 (or to the rear end and top edge of the trailer chassis 102) such that the ramp 114 extends down to the ground surface 109. In this manner, vehicles can then be driven onto or off of the module 100 via the ramp 114 without requiring the module to be unloaded from the trailer chassis 102.

After the vehicles are loaded on or unloaded from the module 100, the ramp 114 can be detached from the module 100 and/or trailer chassis 102, and then stored on the trailer chassis 102 and/or module 100. For example, FIG. 10 illustrates the ramp 114 coupled to the underside of the trailer chassis 102, and FIG. 9 illustrates a pair of storage boxes 120 for storing the ramp or ramps 114. The trailer chassis 102 can then be pivoted to its level position shown in FIG. 10 as the fifth wheel 112 is retracted. The wheels 104 are then returned to their operating position shown in FIG. 10 and the landing gear 112 is retracted. The tractor/trailer combination can then be driven to transport the module 100 and vehicles to a desired location.

Once the tractor/trailer chassis combination and module 100 are driven to the desired location, the vehicles can then be unloaded. The vehicles may be unloaded by reversing the operations described above. For example, the wheels 104 may be moved to their pivot position, the trailer chassis 102 pivoted to its loading position, a ramp 114 attached to the trailer chassis or module 100, and vehicles driven down the ramp. The trailer chassis 102 may the be pivoted to its level position, and the wheels 104 returned to the operating position. Alternately, the entire module 100 may be lifted off of the trailer chassis 102 and located on another carrier for further shipment.

It should be understood that various loading structures may be used instead of the ramp 114 without departing from the scope of the invention. For example, various other ramps or structures of varying sizes and shapes may be used, or vehicles may be driven from a loading dock (not shown) directly into the module 100. Furthermore, although preferred, the trailer chassis 102 need not pivot to its loading position during the loading or unloading process.

The present invention provides a significant advantage in that vehicles can be directly loaded onto or unloaded from the module 100 while the module 100 is located on a trailer chassis 102. For example, if the vehicles could not be loaded directly onto or from module 100 when the module 100 is located on a trailer chassis 102, the module 100 would have to be unloaded from the trailer chassis 102 and placed on the ground or a support surface 109 (such as by a reach stacker), filled with or emptied of vehicles, and then again placed onto and coupled to the trailer chassis 102. The present invention enables a single driver, with a single piece of equipment, to quickly and easily load vehicles into the module 100, transport the vehicles to the desired location, and if desired, quickly and easily unload the vehicles from the module.

The "tilt chassis" of the present invention, that is, the tiltable trailer chassis 102, enables the trailer chassis to tilt from its transport position (FIG. 10) to its loading position (FIG. 11), which makes it quicker and easier to load vehicles onto and off of the trailer chassis 102. For example, because the rear end or loading end of the module is located closed to the ground 109, the ramp 114 can be made smaller, and the angle the ramp 114 forms with the ground 109 and with the module 100 is reduced compared to loading an "untilted" module to provide smoother driving of the vehicles onto and off of the ramp 114.

In many prior art systems, a trailer or chassis that could be coupled to a tractor for transportation could be tilted only by use of the landing gear 112. Furthermore, many prior art systems required that a trailer be disconnected from the tractor before the trailer can be tilted. In contrast, the trailer chassis 102 of the present invention can be tilted by an operator inside the tractor cab without the driver having to exit the cab or uncoupled the trailer chassis from the tractor. Thus the present invention provides a tractor/trailer chassis combination that can be quickly and easily tilted.

Furthermore, because the vehicles are located on a module 100, the filled module 100 itself can be further transported as desired. For example, after the vehicles are loaded in the manner described above and shown in FIGS. 10 and 11, the tractor/trailer combination may be driven to a shipyard, railyard, port, or the like. The filled modules 100 can then be lifted off of the trailer chassis 102, such as by a reach stacker, and then placed onto another carrier such as a rail car, vessel, or another tractor/trailer combination. The system of the present invention may also be used to transport vehicles located inside a module 100 from a shipyard, railyard, port or the like to an end user, such as a vehicle dealer. Thus, the system of the present invention provides for convenient and easy door-to-port, port-to-door, and door-to-door shipping of vehicles.

The module 100 is preferably stackable with other modules to enable compact shipping of the modules. For example, the bottom support structure 18 of each module is preferably shaped to correspond to or complement the roof 44 of the module, such that the modules 100 are contiguously stackable. For example, in the illustrated embodiment the roof 44 of the module 100 is generally flat, as is the bottom support structure 18, which enables the modules 100 to be stacked on top of each other, for example on a rail car or vessel. In this case, the module 100 may be stacked on a lower module (not shown), and an upper module (not shown) may in turn be stacked upon the module.

While the method and apparatus disclosed herein constitute preferred embodiments of the invention, the invention is not limited to these precise methods and apparatuses, and other methods and apparatuses may be used without departing from the scope of the invention.

What is claimed is:

1. A method for transporting vehicles comprising the steps of:

providing a module shaped and sized to receive vehicles therein;

providing a trailer chassis coupled to a tractor, said tractor and said trailer chassis being located on or adjacent to an external surface;

detachably locating said module on said trailer chassis; and driving said vehicles from said external surface into said module wherein said module includes a roof and a bottom support structure which supports said vehicles thereon after said driving step, said roof and said bottom support structure being spaced apart such that only a single layer of vehicles can be received between said roof and said bottom support structure.

2. The method of claim 1 wherein said module is shaped to be contiguously stacked upon other modules.

3. The method of claim 1 wherein said trailer chassis includes a bed and at least one set of wheels, and is detachably coupled to said tractor.

4. The method of claim 1 wherein the method further comprises the step of driving said tractor to a desired location to transport said vehicles located inside said module to said desired location.

5. The method of claim 1 further comprising the step of uncoupling said module from said trailer chassis and placing said module onto a carrier to further transport said vehicles located inside said module.

6. The method of claim 5 wherein said module is stacked on at least one lower module located on said carrier, and wherein at least one upper module is stacked upon said module.

7. The method of claim 4 further comprising the step of driving said vehicles from said module to an external surface at said desired location.

8. The module of claim 7 wherein said vehicles are driven forwardly in both said driving steps.

9. The method of claim 1 further comprising the step of, after said locating step, coupling a ramp to one of said module or said trailer chassis and wherein said vehicles are driven over said ramp during said driving step.

10. The method of claim 9 further comprising the steps of uncoupling said ramp from said one of said module or said trailer chassis and storing said ramp on said trailer chassis.

11. The method of claim 1 further comprising the step of, before said driving step, pivoting said trailer chassis such that a loading side of said module is located closer to said external surface.

12. The method of claim 11 wherein said pivoting step includes activating a hydraulic fifth wheel to cause said pivoting of said trailer chassis.

13. The method of claim 11 wherein said tractor includes a hydraulic fifth wheel, and wherein said hydraulic fifth wheel is used to pivot said trailer chassis.

14. The method of claim 11 wherein said trailer chassis includes at least one set of wheels, and wherein said trailer chassis is pivoted about said set of wheel during said pivoting step.

15. The method of claim 14 further comprising the step of moving said set of wheels closer to a front end of said trailer before said pivoting step.

16. The method of claim 1 wherein said module includes a driver-side side wall and a passenger-side side wall parallel to and laterally spaced from said driver-side side wall and wherein said bottom support structure extends between said side walls and wherein said driver-side side wall includes at least one opening, and wherein a front driver-side door of at least one vehicle driven into said module is opened into said opening when a driver exits or enters said at least one vehicle.

17. The method of claim 16 wherein said driver-side side wall includes a plurality of openings, and wherein a front driver-side door of each vehicle driven into said module is opened into one of said plurality of openings when said a driver enters or exits the associated vehicle.

18. The method of claim 16 wherein said bottom support structure is generally flat, and wherein said locating step includes locating said module on said trailer chassis such that said bottom support structure is located on said trailer chassis.

19. The method of claim 1 wherein said trailer chassis includes a generally horizontal-extending bed and at least one set of wheels.

20. The method of claim 1 wherein said driving step occurs after said locating step.

21. The method of claim 1 further comprising the step of transporting said trailer chassis to a desired location, and driving said vehicles from said module to an external surface at said desired location while said module is located on said trailer chassis.

22. The method of claim 14 wherein said trailer chassis is pivoted about said set of wheels in a first direction during said pivoting step, and wherein the method further comprises, after said driving step pivoting said trailer chassis in a second direction such that said trailer chassis extends generally horizontally.

23. The method of claim 16 wherein each side wall is generally continuous such that said side walls protect the contents of said module.

24. A method for transporting vehicles comprising the steps of:

providing a module shaped and sized to receive vehicles therein;

providing a trailer chassis coupled to a tractor, said tractor and said trailer chassis being located on or adjacent to an external surface;

locating said module on said trailer chassis;

forwardly driving said vehicles from said external surface into said module;

driving said tractor to a desired location to transport said vehicles located inside said module to said desired location; and forwardly driving said vehicles from said module to an external surface at said desired location.

25. A method for transporting vehicles comprising the steps of:

providing a module shaped and sized to receive vehicles therein, wherein said module includes a driver-side side wall, a passenger-side side wall parallel to and laterally spaced from said driver-side side wall, a bottom support structure extending between said side walls and shaped to support said vehicles thereon, and a roof spaced from said bottom support structure such that said roof and said bottom support structure closely receive a single layer of vehicles therebetween, and wherein said driver-side side wall includes at least one opening;

providing a trailer chassis coupled to a tractor, said tractor and said trailer chassis being located on or adjacent to an external surface;

locating said module on said trailer chassis; and driving said vehicles from said external surface into said module, wherein a front driver-side door of at least one vehicle driven into said module is opened into said at least one opening when a driver exits or enters said at least one vehicle.

* * * * *

UNITED STATES PATENT AND TRADEMARK OFFICE

CERTIFICATE OF CORRECTION

PATENT NO. : 6,893,205 B2
DATED : May 17, 2005
INVENTOR(S) : Ralph W. Heim et al.

It is certified that error appears in the above-identified patent and that said Letters Patent is hereby corrected as shown below:

Title page,
Item [75], Inventor, change Prakash W. Shahani's City of residence from "Clinton" to -- Lebanon --.

Signed and Sealed this

Nineteenth Day of July, 2005

JON W. DUDAS
*Director of the United States Patent and Trademark Office*